United States Patent [19]

Namy

[11] 4,154,041

[45] May 15, 1979

[54] WALL WITH EXTENSIBLE JOINTS BETWEEN PANELS

[75] Inventor: Dominique L. Namy, Paris, France

[73] Assignee: Soletanche S.A., Nanterre, France

[21] Appl. No.: 827,190

[22] Filed: Aug. 23, 1977

[30] Foreign Application Priority Data

Aug. 25, 1976 [FR] France ..... 76 256730

[51] Int. Cl.[2] ..... E04B 1/68

[52] U.S. Cl. ..... 52/573; 52/284

[58] Field of Search ..... 52/396, 573, 586, 294, 52/293; 61/39; 256/19, 24; 404/69

[56] References Cited

U.S. PATENT DOCUMENTS

| | | | |
|---|---|---|---|
| 1,447,254 | 3/1923 | Langworthy | 61/39 |
| 2,901,904 | 9/1959 | Wey | 52/396 |
| 3,172,237 | 3/1965 | Bradley | 52/396 |
| 3,195,312 | 7/1965 | Rumsey | 61/39 |
| 3,601,943 | 8/1971 | Danois | 52/586 |
| 3,884,000 | 5/1975 | Faleij | 52/396 |

FOREIGN PATENT DOCUMENTS

| | | | |
|---|---|---|---|
| 1116369 | 11/1961 | Fed. Rep. of Germany | 52/396 |
| 1251313 | 12/1960 | France | 52/396 |
| 577543 | 5/1946 | United Kingdom | 52/586 |

*Primary Examiner*—John E. Murtagh

*Attorney, Agent, or Firm*—Sughrue, Rothwell, Mion, Zinn and Macpeak

[57] ABSTRACT

The invention concerns a wall remaining tight despite possible displacements of its panels because of the terrain.

To this end, it involves joints formed of cylindrical parts 2 and 3, connected by a band 6 consisting of at least one fold 7, of such a kind that the allowed displacement of the panels 16 and 17 entails a deviation less than the length of the unfolded band 6.

The invention applies to all tight walls.

2 Claims, 2 Drawing Figures

WALL WITH EXTENSIBLE JOINTS BETWEEN PANELS

FIELD OF THE INVENTION

The invention concerns a wall that remains tight despite possible displacements of the panels it contains, these panels being immersed in a tight composition and liable to suffer displacements because of the terrain.

BACKGROUND OF THE INVENTION

There already exist walls containing, between two panels, joints composed of two parts with cylindrical and parallel forms, united laterally by a band and having the advantage of constituting a tight joint between two panels when one introduces the cylindrical parts mentioned in grooves of appropriate sections arranged along the edges of two consecutive panels.

Such a wall, however, remains tight only with extremely slight displacements of the panels, and the joints which one interposes cannot be adequate, even when the sections of the grooves present a constriction intended to prevent the cylindrical parts from escaping from the joint if, because of various constraints due to the subsidence of the terrain, the mobility of clay or loam, etc., at least one of the two consecutive panels sways or tilts to a considerable degree in any one direction. Even if a pliable band capable of changing its shape is provided, the tensions to which it has to submit may bring about a rupture or uncertain zones of tightness resulting from cracking of the surrounding medium.

The principal purpose of the present invention is therefore a wall that remains tight despite displacements of the panels which it contains, with this characteristic that it provides for extensible joints capable of changing their shape, without the creation of tensions between two consecutive panels.

Another purpose of the invention is a wall of this type, the joint of which consists of two elements of cylindrical and parallel forms, connected laterally by a band, with this characteristic that on this band one provides for at least one longitudinal fold of such a kind that, whatever the amplitude of the displacement allowed the two consecutive panels, the increase of the distance separating the cylindrical parts of the joint is at least equal to the width of the unfolded band.

In this way, in contrast to the older walls where the very anchoring or fixing of the cylindrical parts of the joints in the grooves often brought about considerable tensions resulting in the rupture of the bands or in a considerable reduction of the tightness, the new wall insures a perfect tightness even in those cases where after the displacement of the panels fissures appear in the outer medium in which they are immersed, the deformation of the band without the development of tensions eliminating all risk of rupture or the beginning of rupture. Other purposes and characteristics of the invention will appear in the course of the following detailed description, made with reference to the attached drawing which shows, by way of a non-restrictive example, a method of carrying out the invention and some variants.

DESCRIPTION OF PREFERRED EMBODIMENTS

Figure 1:
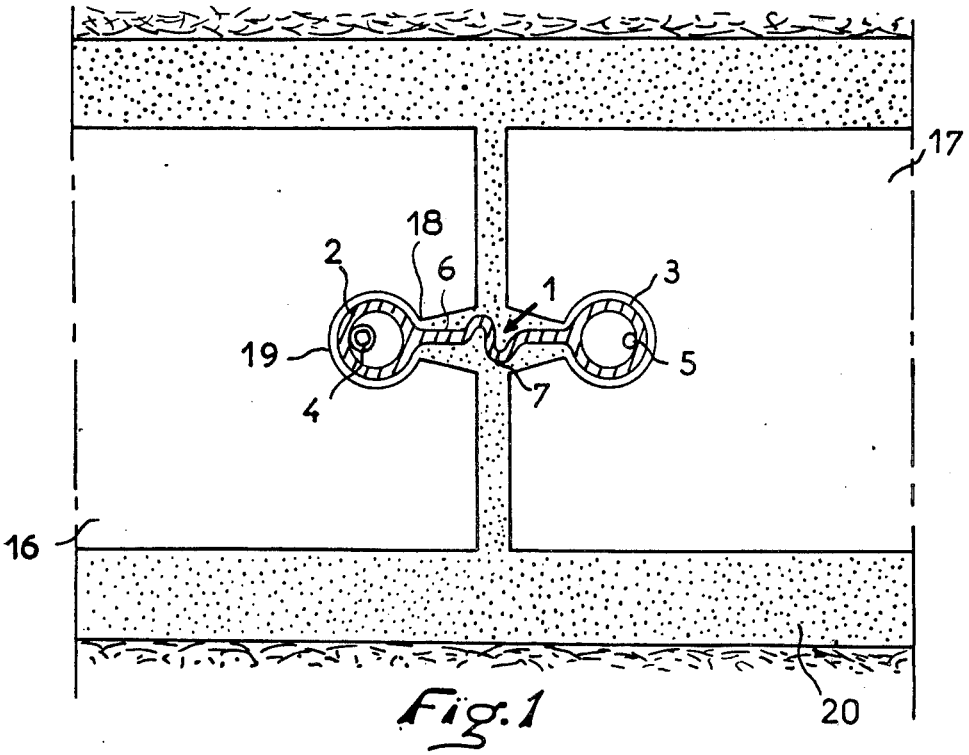
FIG. 1 is a diagrammatic view in horizontal section of a joint set up between two panels.

In the example of FIG. 1, the tightness joint 1 is composed of two tubular cylindrical parts 2 and 3 containing respectively the plunger tubes 4 and 5 with smaller sections, and of a central band 6, which can change its shape without causing tensions and having for this purpose a longitudinal double fold 7.

Figure 2:
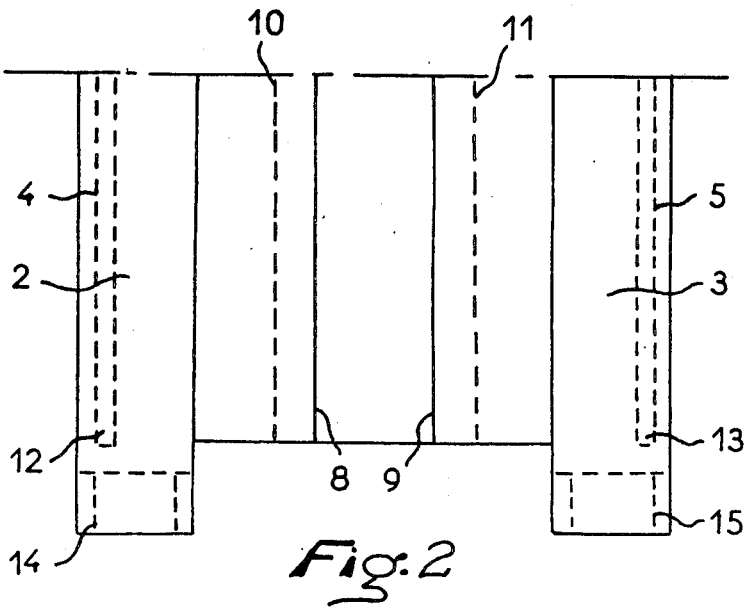
FIG. 2 is a view from above of the lower part of a joint with double fold.

In the example of FIG. 2, the fold 7 has been replaced by two folds indicated by 8 and 9, the respective bottoms of which are represented by the dotted lines 10 and 11. The extremities 12 and 13 of the plunger tubes 4 and 5 are open, as are the extremities of the tubular parts 2 and 3. The latter preferably end in two strengthening pieces 14 and 15, intended to receive either a mounted plug or stopper, not shown in the drawing, or some coupling pieces linking up with a transversal tube. In those cases where one closes the tubular parts, the plugs are fixed before the lowering of the joint.

According to the invention, the placing of element 1 is carried out either after the placing of panels 16 and 17—tubes 2 and 3 being plugged up at their lower extremities or joined up with a transversal tube of any form or diameter whatever or even being left open at the base—or at the same time as the lowering of panel 17, it being assumed that panel 16 is already in place. In the latter case one may already have attached the cylindrical part 3 to panel 17. It would also be possible in certain cases first to attach part 2 to panel 16.

In those applications where the contraction 18 of the groove 19 is sufficient to prevent in this zone the cracking or fissuration of the grout 20 surrounding the panels, one does not need to enclose tubes 4 and 5.

In the contrary case, and especially when the fissures or the micro-fissures of the grout 20 may be reproduced in the interior of the grooves, one applies the tubular parts 2 and 3 against the walls of the grooves by means of inflating or pumping, the pumping material being of the same kind as the grout 20 and possibly containing any usual anti-shrinkage product. In this case, the plunger tubes 4 and 5 serve the evacuation of air at the moment of the filling up of tubes 2 and 3, plugged up at their lower extremity. Inversely, the injection of the grout can be carried out by tubes 4 and 5, the return of air being accomplished by tubes 2 and 3.

If one joins the base of tubes 2 and 3 by a transversal tube, one may in certain cases find it advantageous to use such a non-rigid tube in order to assist the possible displacement of panels 16 and 17 until the final solidification or setting of grout 20.

It is clear that fold 7 has been shown only by way of example and that one can increase the number and the importance of each fold according to the height of the panels used.

As for the materials, any type may be used, provided they have the proper tightness.

It is taken for granted that the plunger tubes 4 and 5 may be fixed or detachable and that one would not be going beyond the scope of the invention if one replaced the plaited band 6 with a tight plaited envelope or cover, capable of changing its shape, which can be filled under pressure in a suitable manner and which can also communicate with volumes 2 and 3.

In case elastic bands are used, the fold is always present in order to render minimal the pressure or tension of the band.

I claim:

1. In a tight wall having a plurality of vertically oriented end-to-end panels embedded in a hardened liquid grout and including joints between consecutive panels, the improvement comprising, said joints being extensible and capable of changing their shape without constraint, each joint including two parallel and tubular parts connected laterally by a band, said tubular parts adapted to fit into and be retained by hollow tubular sections in each panel, said band comprising at least one longitudinal fold dimensioned such that at a maximum range of displacement between the consecutive panels, the increase in the distance separating the tubular parts of the joint is, at most, equal to the width of the unfolded band, and an auxiliary plunger tube of smaller diameter removably disposed in the interior of each tubular part.

2. In a tight wall having a plurality of vertically oriented end-to-end panels embedded in a hardened liquid grout and including joints between consecutive panels, the improvement comprising, said joints being extensible and capable of changing their shape without constraint, each joint including two parallel and tubular parts connected laterally by a band, said tubular parts adapted to fit into and be retained by hollow tubular sections in each panel, said band comprising at least one longitudinal fold dimensioned such that at a maximum range of displacement between the consecutive panels, the increase in the distance separating the tubular parts of the joint is, at most, equal to the width of the unfolded band, said tubular parts having lower extremities which are open and which possess means for attaching a coupling piece thereto.

* * * * *